US005717370A

United States Patent [19]

Haas

[11] Patent Number: 5,717,370

[45] Date of Patent: Feb. 10, 1998

[54] ELECTROMAGNETIC SWITCHING DEVICE, PARTICULARLY CONTACTOR

[75] Inventor: Heinz Haas, Gebenstorf, Switzerland

[73] Assignee: Allen-Bradley Company, Inc., Milwaukee, Wis.

[21] Appl. No.: 601,634

[22] Filed: Feb. 14, 1996

[30] Foreign Application Priority Data

Apr. 20, 1995 [CH] Switzerland ..... 01126/95

[51] Int. Cl.[6] ..... H01H 67/02

[52] U.S. Cl. ..... 335/132; 335/202

[58] Field of Search ..... 335/132, 131, 335/202

[56] References Cited

U.S. PATENT DOCUMENTS

| | | | |
|---|---|---|---|
| 4,710,740 | 12/1987 | Dennison | 335/248 |
| 4,980,801 | 12/1990 | Guinda et al. | 361/394 |
| 5,296,826 | 3/1994 | Hart et al. | 335/132 |

*Primary Examiner*—Lincoln Donovan

*Attorney, Agent, or Firm*—John M. Miller; John J. Horn

[57] ABSTRACT

In an electromagnetic switching device, particularly in a contactor, a connecting piece, which is flexible in all directions, is fitted between the armature (9) and the contact bridge carrier (6). An intermediate plate (8) carrying elastic bars (14, 15) is placed between the armature (9) and the contact bridge carrier (6) so that it rests torsion-free against the contact bridge carrier (6). The elastic bars (14, 15) act upon both end regions of a coupling bolt (10) guided through a hole (19) in the armature (9), as well as in a direction perpendicular to it upon both end regions of the armature (9). The coupling bolt (10), and therefore also the armature (9), are connected to the contact bridge carrier (6) via a tow connection The intermediate plate (8), which holds the armature (9) and the contact bridge carrier (6) apart through an elastic tension, guides, with the help of the guiding elements (20) molded on it, both the contact bridge carrier (6) as well as the armature (9) into the housing (1) of the switching device. The coupling bolt (10) rests at least at both end regions of the hole (19) in the armature (9), and therefore, the bending stress imposed upon the coupling bolt (10) during impacts is held at a low value.

7 Claims, 3 Drawing Sheets

ELECTROMAGNETIC SWITCHING DEVICE, PARTICULARLY CONTACTOR

BACKGROUND OF THE INVENTION

The invention at hand relates to an electromagnetic switching device, particularly a contactor, with an elastic connection between the armature and the contact bridge carrier with an armature, a contact bridge carrier movable into the housing of the switching device, and a coupling bolt, used as a means of coupling to the contact bridge carrier, inserted into the armature through a hole perpendicular to the direction of motion. Several elastic elements arranged symmetrically around the axis of symmetry of the contact bridge ogler create the elastic tension that holds the armature and the contact bridge carrier apart.

From DE-C-2142464, we are aware of an electromagnetic switching device of the kind mentioned earlier. In this switching device, an arrangement is provided which links the armature to the contact bridge carrier through a connection that is flexible in all directions. Here, it was proceeded in the assumption that, in order for a connection to be flexible in all directions, a centrally supported small surface area between the armature and the contact bridge carrier attached to the coupling bolt was required. Therefore, the coupling bolt rests only at the center of the hole against the armature in a central position. The elastic tension needed to hold the armature and the contact bridge carrier apart from each other is created by the means of elastic elements symmetrically arranged around the axis of symmetry of the contact bridge carrier; the axis lies parallel to the armature's direction of motion. As a result of the connection between the armature and the contact bridge carrier, which is flexible in all directions, a high bending stress is imposed upon the coupling bolt. In order to maintain the central contact point of the coupling bolt inside the armature hole in the correct central position, the coupling bolt must be installed accurately in the desired position in such a way that no displacements can take place. On both ends of the coupling bolt, gliding extensions are mounted to guide the contact bridge carrier into the housing of the switching device. This known arrangement consists of too many single parts, thus making the required assembly procedure too complicated and rendering the arrangement economically disadvantageous.

The objective of the invention at hand is to develop an electromagnetic switching device of the earlier mentioned type, whereby the coupling bolt—which is inserted in the armature hole and is used for the purpose of attaching the armature to the contact bridge carrier through a connection that is flexible in all directions—is exposed to relatively small bending stresses when subjected to impacts, and can be installed without the need for positioning. The device consists of relatively few parts, exhibits a long lifespan, and is economically advantageous.

These objectives are obtained through the provision of an intermediate plate placed between the armature and the contact bridge carrier, which rests torsion-free against the contact bridge carrier perpendicular to the direction of motion, supports itself elastically at both end regions of the coupling bolt as well as in a direction perpendicular to that at the end regions the of the armature by the means of the elastic elements, and is equipped with several guiding elements which can be engaged with the guiding parts in the housing. In addition, the objectives are obtained also through the coupling bolt which rests at least at both end regions of the hole upon the armature, and is in a tow connection with the contact bridge carrier. The intermediate plate is simple to manufacture and economically advantageous. By using the intermediate plate, the mounting of the switching device becomes especially suitable for simple automatic assembly. When subjected to impacts, the bending stress acting upon the coupling bolt is relatively low, because of the fact that the coupling bolt rests at least at both end regions of the hole upon the armature. Therefore, a relatively long lifespan of the switching device is obtainable. The tow connection between the coupling bolt and the contact bridge carrier allows an elastic swing motion of the armature against the force of the elastic elements acting upon both end regions of the coupling bolt and perpendicular to that upon the end regions of the armature. The intermediate plate also guides the contact bridge carrier and the armature into the housing of the switching device. The intended design consists of relatively few parts and is economically advantageous.

The intermediate plate favorably presents at least one drive junction for at least one backup switching device, which is attachable to the side of the original switching device. The intermediate plate is especially suitable for the provision of a drive junction accessible from the outside.

An advantage of the elastic elements, which exert a spring force between the intermediate plate and the armature on the one hand, and between the intermediate plate and the coupling bolt on the other, is that they consist of elastic bars molded onto the intermediate plate. This solution is noticeably favorable, because the intermediate plate along with the elastic elements is formed as a one piece component.

The intermediate plate may be made of thermoplastic material. The good bending characteristics of the thermoplastic material necessary for the manufacturing of the elastic bars, as well the material's good gliding characteristic necessary for guiding the intermediate plate inside the housing, are here well utilized.

The contact bridge carrier may be made of thermosetting polymer. With thermosetting polymer, mechanical strength of the contact bridge carrier and the firmness and durability of its shape are sufficiently realized for all kinds of switching devices.

BRIEF DESCRIPTION OF THE DRAWINGS

In the following, an example on how the invention is implemented, is described in detail using the enclosed drawings. The figures show the following.

DETAILED DESCRIPTION OF THE PREFERRED EMBODIMENT

Figure 1:
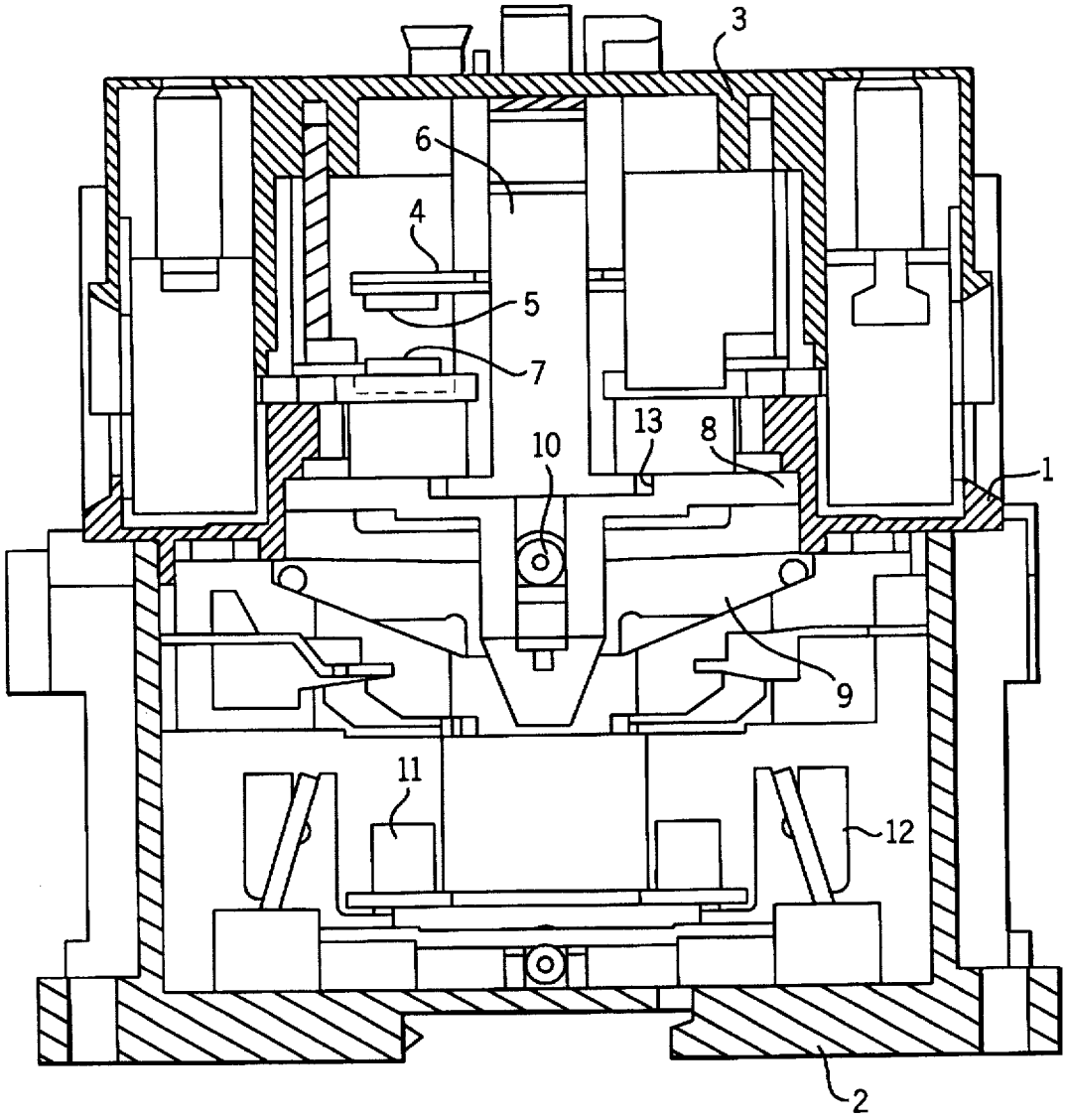
FIG. 1 A cross sectional diagram of the electromagnetic switching device.

In FIG. 1, the cross sectional diagram of an electromagnetic switching device, or more precisely of a contactor, shows a housing (1), a housing base (2), and an upper part (3) of a housing. Inside the housing (1) and in its upper part (2), contact bridges (4) holding movable contacts (5) are attached to a contact bridge carrier (6). The housing (1) carries the fixed contacts (7). The contact bridge carrier (6)

lies perpendicular to the direction of motion, resting torsion-free against an intermediate plate (8). The intermediate plate (8) lies between the contact bridge carrier (6) and the armature (9) of the electromagnet. The fastening mechanism of the contact bridge carrier (6) to the armature (9) using a coupling bolt (10) will be explained later. The core (12) of an electromagnet holding a magnetic coil (11) is attached onto the base (2) of the housing.

Figure 2:
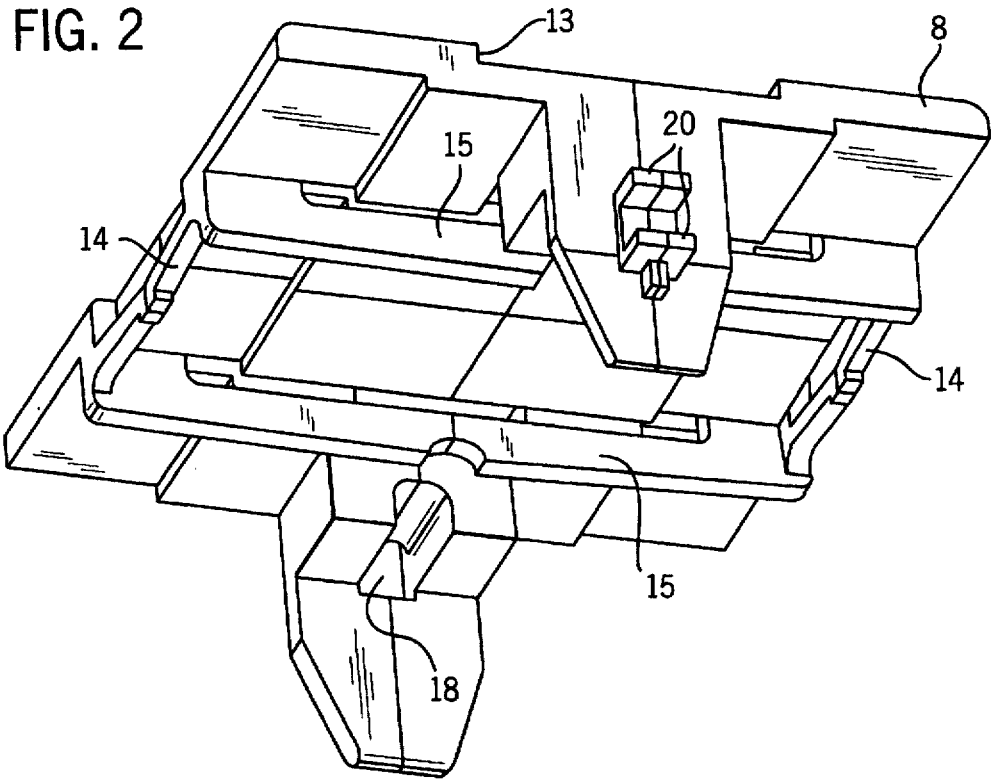
FIG. 2 The three dimensional representation of the intermediate plate.
Figure 4:
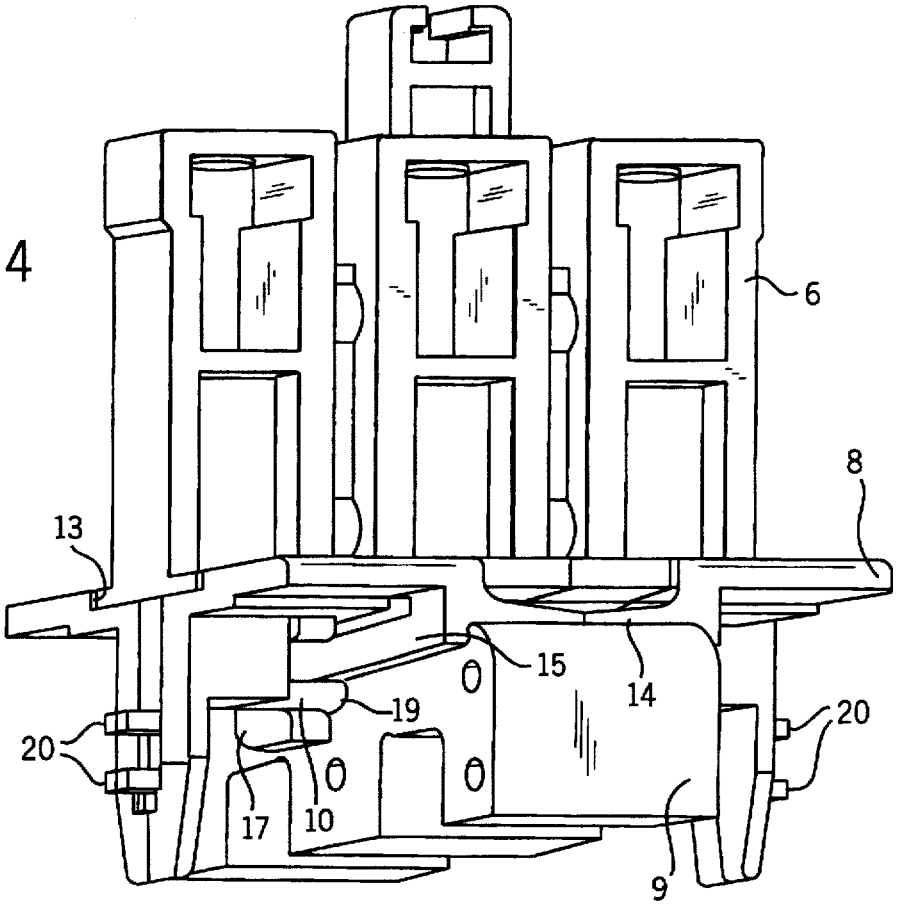
FIG. 4 A perspective drawing of the coupling bolt assembled together with the contact bridge carrier.
Figure 3:
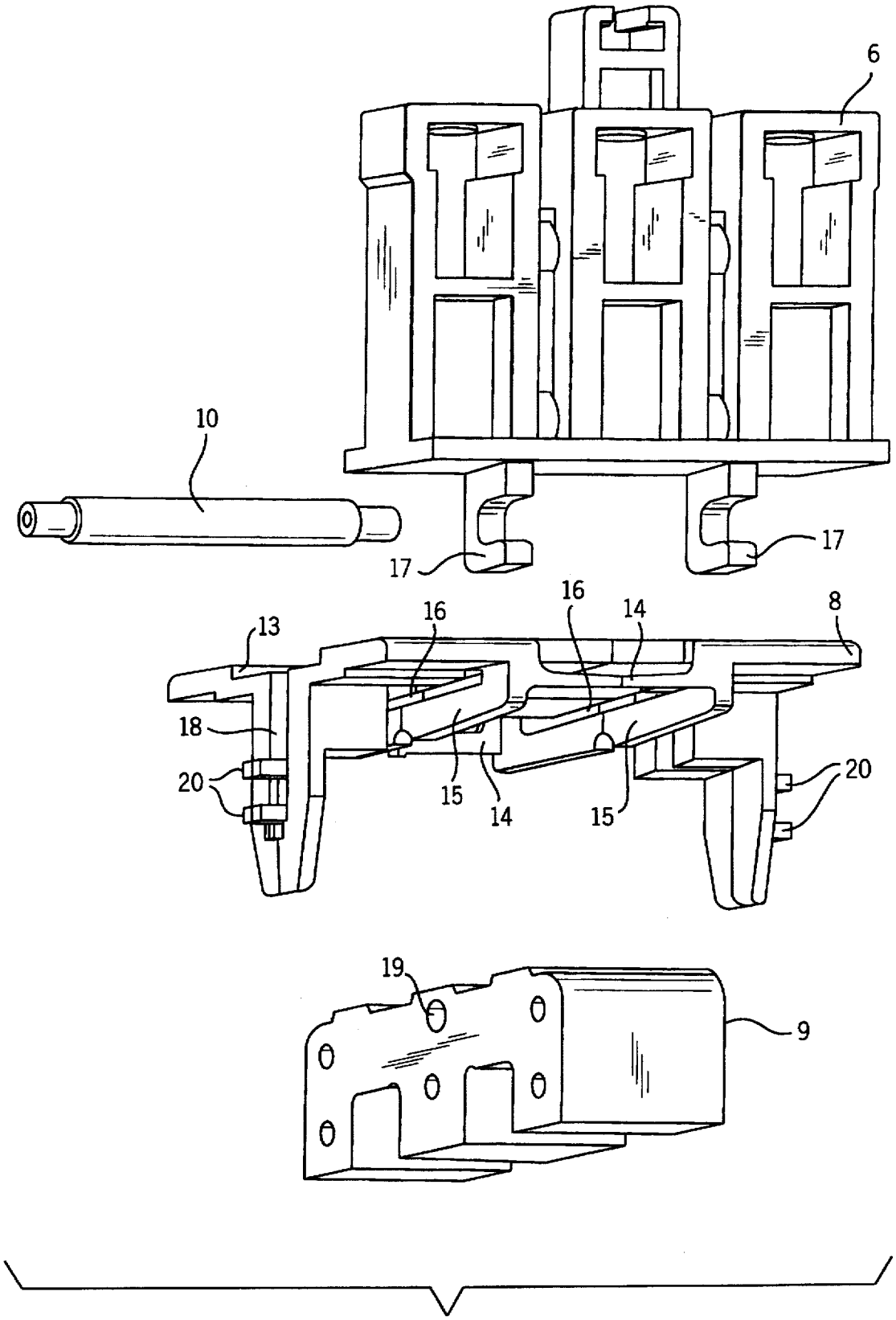
FIG. 3 A three dimensional representation depicting the alignment of the in-all-directions elastic arrangement consisting of the contact bridge carrier, intermediate plate, armature, and coupling bolt.

In FIG. 2, only the intermediate plate (8) is depicted in a three dimensional representation. On the side that faces the contact bridge carrier (6), a wide groove (13) is recognizable, in which the contact bridge carrier (6) is placed in a torsion-free manner, perpendicular to the direction of motion, as seen in FIGS. 1, 3, and 4. The intermediate plate (8) carries on its side that faces the armature (9) elastic elements which hold the armature (9) and the contact bridge carrier (6) apart through an elastic tension. The elastic elements adjacent to the end regions of the armature (9) consist of two elastic armature-bars (14) and those adjacent to the end regions of the coupling bolt (10) consist of two elastic bolt-bars (15). The intermediate plate (8) is manufactured using thermoplast material, which possesses good bending characteristics, enabling the elastic bars (14, 15) to secure a good elastic connection between the armature (9) and the contact bridge carrier (6). The intermediate plate (8) has two cuttings (16) visible in FIG. 3. The two coupling hooks (17) of the contact bridge carrier (6) are pushed through these cuttings (16). The coupling bolt (10) is pushed to penetrate through the opening (18) in the intermediate plate (8), which is placed on top of the armature (9), through the coupling hooks (17) of the contact bridge carrier (6), and through the hole (19) in the armature (9) perpendicular to the direction of motion. The coupling bolt (10) rests upon the full length of the hole (19) in the armature (9).

As seen in FIG. 4, in the full assembled connecting-arrangement between the armature (9) and the contact bridge carrier (6), the contact bridge carrier (6) is in tow connection with the end regions of the coupling bolt (10) via the two coupling hooks (17). Both elastic bolt-bars (15) rest adjacent to the coupling hooks (17) upon the end regions of the coupling bolt (10). The tow connection as well as the elastic bolt-bars (15) allow an elastic swinging motion of the armature (9) relative to the contact bridge carrier (6) in a plane extending through the length of the coupling bolt (10) in the direction of motion. Also, an elastic swinging motion along the long axis of the coupling bolt (10) is made possible thank to the two armature-bars (14) resting against the end regions of the armature (9). Thus, it is possible to establish a connection between the armature (9) and the contact bridge carrier (6), which is elastic in all directions.

On both its sides, the intermediate plate (8) is equipped with protruding guiding elements (20), which, through corresponding guiding parts inside the housing (1) not depicted in the figure, provide the guidance of the contact bridge carrier (6) inside the housing (1). The guiding elements function simultaneously as drive junctions for a not depicted backup switching device that could be installed on the side of the original switching device. In this case, the guiding elements (20) glide in an open groove in the housing panel.

The one-piece intermediate plate (8) made of thermoplast material serves, on the one hand, as a bracing element between the armature (9) and the contact bridge carrier (6) due to its good elastic properties. On the other hand, due to its gliding properties, it serves as a guiding element for the contact bridge carrier (6) inside the housing (1). The contact bridge carrier (6), independent of the intermediate plate (8), is made of thermosetting polymer possessing both mechanical strength and shape firmness and durability, which are satisfactory for all kinds of switching devices.

I claim:

1. Electromagnetic switching device, particularly a contactor, with an elastic connection between the armature (9) and the contact bridge carrier (6), consisting of an armature (9), a contact bridge carrier (6) movable into the housing (1) of the switching device, and a coupling bolt (10) inserted into the armature (9) through a hole (19) perpendicular to the direction of motion to make a connection to the contact bridge carrier, Whereby the armature (9) and the contact bridge carrier (6) are held apart through an elastic tension caused by several elastic elements (14, 15) arranged symmetrically around the axis of symmetry of the contact bridge carrier parallel to the direction of motion, is characterized by the provision of an intermediate plate (8) placed between the armature (9) and the contact bridge carrier (6) and resting torsion-free against the contact bridge carrier (6) perpendicular to the direction of motion, which supports itself elastically at both end regions of the coupling bolt (10) as well as in a direction perpendicular to it at the end regions the of armature (9) by the means of the elastic elements (14, 15), and is equipped with several guiding elements (20) which can be engaged with guiding parts inside the housing (1). Furthermore, the coupling bolt (10) rests at least at both end regions of the hole upon the armature (9), and is in a tow connection with the contact bridge carrier (6) at both its end regions.

2. Electromagnetic switching device, in accordance with claim 1, is characterized by the fact that the intermediate plate (8) is equipped with at least one drive junctions (20) for at least one backup switching device that could be installed on the side of the original switching device.

3. Electromagnetic switching device, in accordance with claim 1, is characterized by the fact that the elastic elements (14, 15) consist of elastic bars (14, 15) molded onto the intermediate plate (8) and exert a spring force between the intermediate plate (8) and the armature (9) on the one hand, and between the intermediate plate (8) and the contact bridge carrier (6) on the other.

4. Electromagnetic switching device, in accordance with claims 3, is characterized by the fact that the intermediate plate (8) is made of thermoplastic material.

5. Electromagnetic switching device, in accordance with claim 1, is characterized by the fact that the contact bridge carrier (6) is made of thermosetting polymer.

6. An electromagnetic switching device comprising:

an armature;

a moveable contact bridge carrier;

an intermediate plate having at least one elastic element, the intermediate plate coupled to the armature and the contact bridge carrier, the elastic elements damping forces exerted by the armature upon the contact bridge carrier; and a coil positioned to electromechanically interact with the armature when energized.

7. The electromechanical switching device according to claim 6 wherein the at least one elastic element comprises elastic bars molded into the intermediate plate.

* * * * *